US009368339B2

(12) United States Patent
Haacke et al.

(10) Patent No.: US 9,368,339 B2
(45) Date of Patent: Jun. 14, 2016

(54) DISCHARGE LAMP WITH HIGH COLOR TEMPERATURE

(75) Inventors: Michael Haacke, Aachen (DE); Bernd Prokesch, Cologne (DE)

(73) Assignee: Koninklijke Philips N.V., Eindhoven (NL)

( * ) Notice: Subject to any disclaimer, the term of this patent is extended or adjusted under 35 U.S.C. 154(b) by 0 days.

(21) Appl. No.: 14/113,772

(22) PCT Filed: Apr. 19, 2012

(86) PCT No.: PCT/IB2012/051956

§ 371 (c)(1),
(2), (4) Date: Oct. 24, 2013

(87) PCT Pub. No.: WO2012/147014

PCT Pub. Date: Nov. 1, 2012

(65) Prior Publication Data

US 2014/0042889 A1 Feb. 13, 2014

(30) Foreign Application Priority Data

Apr. 27, 2011 (EP) ..... 11163797

(51) Int. Cl.
*H01J 61/33* (2006.01)
*H01J 61/34* (2006.01)
*H01J 61/82* (2006.01)

(52) U.S. Cl.
CPC ..... *H01J 61/33* (2013.01); *H01J 61/34* (2013.01); *H01J 61/827* (2013.01)

(58) Field of Classification Search
CPC ..... H01J 61/33; H01J 61/34; H01J 61/827
See application file for complete search history.

(56) References Cited

U.S. PATENT DOCUMENTS 8,030,847 B2 * 10/2011 Haacke et al. ..... 313/634
8,410,698 B2 * 4/2013 Haacke et al. ..... 313/637

(Continued)

FOREIGN PATENT DOCUMENTS

CN 101533755 A 9/2009
CN 101636816 A 1/2010

(Continued)

OTHER PUBLICATIONS

Brock, Lori R. "The Wettability of Sapphire, Polycrystalline Alumna, and Quartz by Molten Metal Halide Salts", Science Direct, Journal of Physics and Chemistry of Solids, vol. 66, 2005, pp. 484-487.

(Continued)

*Primary Examiner* — Thomas A Hollweg

(57) ABSTRACT

A discharge lamp comprises a discharge vessel 20 defining a sealed inner discharge space 22 with two electrodes 24. A filling consists of a rare gas and a metal halide composition and is free of mercury. The discharge vessel 20 comprises outer grooves 36 where the electrodes 24 are embedded, arranged at a groove distance Ra between them. The discharge vessel 20 further comprises an inner diameter ID. In operation of the lamp, an arc discharge is formed between the electrodes and the metal halide composition is partly evaporated. After operation of the lamp, the metal halide composition forms a film on the inner wall of the discharge vessel 20. This film has a surface area $A_S$ measured in $mm^2$. The metal halide composition is provided in such an amount within the discharge space 22, that a matching quotient Q, calculated as $Q=Ra \times ID/A_S$ has a value of 2 or more, such that a high color temperature is achieved.

20 Claims, 5 Drawing Sheets

(56) References Cited

U.S. PATENT DOCUMENTS

| | | | | |
|---|---|---|---|---|
| 8,598,789 | B2 * | 12/2013 | Haacke et al. | 313/638 |
| 2003/0076041 | A1 * | 4/2003 | Honda et al. | 313/634 |
| 2009/0108756 | A1 * | 4/2009 | Eisemann | 313/639 |
| 2009/0167182 | A1 * | 7/2009 | Frick | 313/642 |
| 2009/0200944 | A1 | 8/2009 | Takatsuka | |
| 2010/0109522 | A1 | 5/2010 | Haacke | |
| 2010/0141138 | A1 | 6/2010 | Haacke | |
| 2010/0213807 | A1 | 8/2010 | Haacke | |
| 2011/0031878 | A1 * | 2/2011 | Haacke et al. | 313/570 |
| 2011/0156582 | A1 * | 6/2011 | Haacke et al. | 313/638 |

FOREIGN PATENT DOCUMENTS

| | | | |
|---|---|---|---|
| JP | 2009218203 | A | 9/2009 |
| WO | 2006025027 | A2 | 3/2006 |
| WO | 2009127993 | A1 | 10/2009 |
| WO | 2010001316 | A1 | 1/2010 |
| WO | 2011018741 | A2 | 2/2011 |
| WO | 2011042830 | A2 | 4/2011 |

OTHER PUBLICATIONS

EP Application No. 12721354.4 (National Stage of PCT/IB2012/051956, filed Apr. 19, 2012), Article 94(3) Office Action dated Sep. 7, 2015.

CN Application No. 2012-800202587 (National Stage of PCT/IB2012/051956, filed Apr. 19, 2012), Office Action dated Aug. 4, 2015.

Office Action mailed Feb. 9, 2016 from Japanese Application No. 2014-506961.

Second Office Action issued Jan. 29, 2016 from Chinese Application No. 2012-800202587.

* cited by examiner

DISCHARGE LAMP WITH HIGH COLOR TEMPERATURE

CROSS-REFERENCE TO PRIOR APPLICATIONS

This application is the U.S. National Phase application under 35 U.S.C. §371 of International Application No. PCT/IB2012/051956, filed on Apr. 19, 2012, which claims the benefit of European Patent Application No. 11163797.1, filed on Apr. 27, 2011. These applications are hereby incorporated by reference herein.

FIELD OF THE INVENTION

The present invention relates to a high-pressure gas discharge lamp, in particular for use in automotive front lighting.

BACKGROUND OF THE INVENTION

Discharge lamps, specifically HID (high-intensity discharge) lamps are used for a large area of applications where high luminous flux is required. Especially in the automotive field, HID lamps are used as vehicle headlamps.

A discharge lamp comprises a sealed discharge vessel, which may be made e.g. from quartz glass, with an inner discharge space. Two electrodes project into the discharge space, arranged at a distance from each other, to ignite an arc therebetween. The discharge space has a filling comprising a rare gas and further ingredients such as metal halides.

An important aspect today is energy efficiency. The efficiency of a discharge lamp may be measured as lumen output in relation to the electrical power used. In discharge lamps used today for automotive front lighting an efficiency of about 90 lumen per Watt (lm/W) is achieved at a steady state operating power of 35 Watt.

Discharge lamps with lower nominal power, e.g. in the range of 20-30 W, in particular 25 W have already been proposed. However, it is not sufficient to use prior 35 W designs for operation at 25 W, because these show a drastically reduced efficiency if operated at lower power. In order to still deliver sufficient luminous flux for automotive front lighting, HID lamps need to have a special design to yield at the reduced operating power high efficiency.

WO 2009/127993 A1 describes a high pressure gas discharge lamp with a discharge vessel, in which electrodes project into a discharge space of a volume of 12-20 $mm^3$. The discharge space has a filling of a rare gas and a metal halide composition free of mercury. The lamp is intended to operate in steady state operation at an electrical power of 25 W with a luminous flux corresponding to an efficiency of greater than 90 lm/W. In preferred examples, a discharge space is of cylindrical shape and has an inner diameter of 2.2 mm. The discharge vessel is of externally ellipsoid shape with an outer diameter of 5.5 mm. An outer bulb is provided around the discharge vessel filled with a gas filling of reduced pressure to obtain a defined heat transition coefficient. A discharge vessel is filled with Xenon at 15-18 bar cold pressure. A metal halide composition is contained in the discharge space, comprising in a first example only NaI and $ScI_3$ and in further examples additionally $ThI_4$. The metal halides are provided in a quantity of 15.8 μg/μl and 10.52 μg/μl.

In discharge lamps today, there is an increasing demand for lamps delivering light at high color temperature, such as up to 5000 K. Thus, lamp designs intended for high efficiency at reduced power would have to be redesigned to deliver the required color temperature light also.

SUMMARY OF THE INVENTION

It is an object of the present invention to provide a lamp that allows energy efficient operation at reduced power with a high color temperature.

The present inventors have recognized that designing a discharge lamp for higher color temperature by the straightforward method of only adjusting the metal halide composition, i.e. the type and relative amounts of halides contained in the discharge vessel, may conflict with the requirement for high efficiency at reduced operating power, in particular 25 W.

In researching the influence of different parameters on color temperature, the inventors have made the surprising discovery that a careful match of the amount of halides provided within the discharge vessel in relation to the size and shape of the discharge space has a decisive influence on the color temperature.

In accordance with these findings, the present invention proposes a discharge lamp which comprises, as customary, a discharge vessel defining a sealed discharge space with at least two electrodes projecting therein. The discharge space comprises a filling of a rare gas, preferably Xenon, and a metal halide composition which is at least substantially free of mercury, i.e. contains no mercury at all or only unavoidable impurities thereof.

The discharge vessel may be defined in terms of geometrical parameters, in particular an inner diameter ID and a groove distance RA. The inner diameter is the diameter of the inner discharge space measured in a central position between the electrodes. The groove distance RA is a distance between the longitudinal ends of the discharge vessel, measured at the respective center of outer grooves formed where the electrodes are embedded in the material of the discharge vessel wall, preferably quartz glass. The groove distance RA thus is a measure of the longitudinal extension of the discharge vessel.

As known to the skilled person, the metal halides provided within the discharge vessel are in steady-state operation of the lamp at least partly evaporated. After operation of the lamp in a horizontal arrangement, if the lamp is turned off, the metal halides again solidify forming a film on the inner discharge vessel wall, also referred to as a "salt lake". This film usually condenses around the "coldest spot" of the discharge vessel wall, located centrally below the electrodes.

The size of the film thus forming depends on the size and shape of the discharge vessel and on the amount of metal halides provided. A measure for the size of the film may be a surface area $A_S$ measured in $mm^2$. The surface area $A_S$ may be measured by observing the lamp with the re-solidified film after operation in horizontal orientation directly from below, identifying the extent of the "salt lake", and measuring the surface.

The inventors have found that a matching quotient Q calculated as the product of groove distance RA and inner diameter ID, divided by the surface area $A_S$ of the film, surprisingly plays an important role with regard to the color temperature of the light emitted from the lamp.

For values of the matching quotient Q of below 2, relatively low color temperatures are achieved. For matching quotients Q of 2 or more, a desired higher color temperature is achieved. Particularly preferred are values for the matching quotient Q of 2.5 or more, further preferred 3 or more. While the absolute value of color temperature obtained for a specific value of the matching quotient Q depends on further parameters such as the metal halide composition etc., the relative value of the obtained color temperature shows a strong dependence on the matching quotient Q. For a preferred example of a metal halide composition, a matching quotient of Q=2 led to a color temperature of about T=4700 whereas a color temperature of almost T=4900 was obtained for a matching quotient Q=3 with the same metal halide composition and also otherwise unchanged parameters.

The surprising influence could be explained by the fact that the matching quotient Q is indicative of the way the halides contact portions of the discharge vessel with different temperatures. During operation of the discharge lamp in steady-state a temperature profile forms in the wall surrounding the discharge vessel, with a hot spot centrally between the electrodes above the arc discharge and a coldest spot opposite to this, centrally between the electrodes below the discharge. Since heat is also coupled into the discharge vessel wall from the electrodes, the end portions of the discharge vessel, where the electrodes are embedded, will also be at a rather high temperature. Thus, the resulting temperature profile will have significant temperature differences in the lower discharge vessel wall between the coldest spot and the longitudinal ends, where the electrodes are embedded. The metal halides contained within the discharge vessel, in particular while not evaporated, are in contact with this lower discharge vessel wall. The halides will partly evaporate while contacting these lower regions of the discharge vessel wall at their different temperatures. Thus, depending on a match between the extension of the salt lake, of the shape of the discharge vessel wall enclosing the salt lake, and the temperature profile, different portions of the metal halides will in operation of the lamp evaporate at different temperatures, leading to a formation of different reactive species. As a result, the color temperature will show a certain dependence on the match between the above factors. As experimental results have shown, the matching quotient Q in fact is a good measure for this match and provides a model for the influence of the above factors on color temperature.

The matching quotient Q thus provides a convenient measure for a special match of the most relevant geometrical parameters of the discharge vessel and of a corresponding metal halide filling suited to design a lamp of desired high color temperature. By observing the matching quotient Q as a matching parameter, it is possible to still use a most efficient composition of the metal halides, and thus obtain the high color temperature without significant loss of efficiency. Thus, lamps with a matching quotient Q of 2 or more according to the invention achieve to fulfill the conflicting requirements of high luminous efficiency and high color temperature.

Especially preferred, the lamp may be disposed to yield during operation at a steady state electrical power of 25 W a luminous flux of at least 1800 lm, i.e. an efficiency of 72 lm/W or more. In the present context, the luminous flux measured in lm and the efficiency measured in lm/W referred to is always measured at a burnt-in lamp, i.e. after the discharge lamp has been first started and operated for 15 h according to a burn-in sequence. Preferably, the efficiency is even higher, such as 78 lm/W or more.

The efficiency of a discharge lamp at such reduced power may be influenced by a number of parameters to achieve the desired values. As will become apparent in connection with the preferred embodiments discussed below, there are several measures which may be used to obtain a lamp of the desired high efficiency at of 25 W. These measures refer on one hand to the discharge vessel itself, where a small inner diameter and a thin wall help to achieve high efficiency. On the other hand, this refers to the filling within the discharge space, where specific compositions with a relatively high amount of the light emitting halides of Sodium and Scandium (as opposed to other halides, contained in the composition) are provided. Further, the high pressure of the rare gas within the discharge space, and measures directed to lower the heat conduction via the outer enclosure serve to provide more lumen output.

The discharge vessel may e.g. have spherical, cylindrical, ellipsoidal or any other shape. Preferably, it has an outside ellipsoid shape and an inner ellipsoidal or, particularly preferred, cylindrical shape. According to a preferred embodiment the discharge vessel has a volume of 15-21 $mm^3$ (or μl). Further preferred is a volume of 17-20 $mm^3$.

The geometric design of the discharge vessel should be chosen according to thermal considerations. In particular the "coldest spot" temperature should be kept high to achieve high efficiency. Generally, the inner diameter of the discharge vessel should be chosen relatively small, e.g. 2.0-2.4 mm. The inner diameter should preferably be at least 2.0 mm to avoid too close proximity of the arc to the discharge vessel wall. According to a preferred embodiment, the discharge vessel has an inner diameter (measured in a plane central between the electrodes in orthogonal orientation thereto) of 2.1-2.3 mm.

The wall thickness of the discharge vessel (also measured in a plane central between the electrodes in orthogonal orientation thereto) may preferably be chosen to be 1.5-1.9 mm. According to a preferred embodiment, the wall thickness is 1.5-1.75 mm, so that a relatively small discharge vessel is provided, which has a reduced heat radiation and is therefore kept hot even at lower electrical powers.

Preferably, the inner discharge space has a centrally arranged cylindrical portion. Thus, the inner discharge vessel wall is straight over a specified length of preferably 3-5 mm. Adjacent to the cylindrical portion, end portions of the discharge vessel are formed, leading up to the position where the electrodes are embedded. The groove distance RA may be e.g. 6-10 mm, preferably 7-9 mm, most preferred 8±0.2 mm. It has been found that for a discharge space shaped with a central cylindrical portion with a length between 25% and 75%, preferably 50%±10% of the groove distance RA the matching quotient Q is especially well suited to design a lamp with a desired color temperature.

According to a further preferred embodiment, the metal halide composition composition comprises at least halides of Sodium (Na) and Scandium (Sc), preferably NaI and $ScI_3$. The mass ratio of the halides of Na and Sc is (mass of Na halide)/(mass of Sc halide)=0.8-1.3, preferably 0.9-1.2. Preferably, the metal halide composition comprises further halides besides halides of Sodium and Scandium. It is particular preferred to further use halides of Thulium and Indium. However, these halides do not substantially contribute to the lumen output, so that according to a preferred embodiment the metal halide composition comprises at least 60 wt % halides of Scandium and Sodium, preferably 70 wt % or more, and most preferred 79±5 wt-%.

In particular to obtain a high color temperature, it is further preferred that the metal halide composition comprises halides of Thulium. Preferably, the metal halide composition comprises at least 10 wt-% halides of Thulium, further preferred at least 15%, most preferably 20+/−3 wt-%. Further, in particular in metal halide compositions comprising an amount of Thulium halide, it is preferred for a high color temperature to provide a certain amount of Indium halide, such as 0.05-0.7 wt-%, preferably 0.4-0.6 wt-%. Further, optionally, a certain amount, e.g. 1-4 wt-% of Thorium iodide may be present within the metal halide composition.

The rare gas provided in the discharge space is preferably Xenon. The rare gas may be provided at a cold (20° C.) filling pressure of 10-18 bar. Most preferably, a relatively high gas pressure of 12-16 bar is used. Such a high pressure provides high lumen output and at the same time may lead to a relatively high burning voltage.

As a further measure to provide high efficiency, the lamp comprises an outer enclosure provided around the discharge vessel. It may serve—besides other uses, such as e.g. blocking UV radiation—to achieve a certain, limited heat flow from the discharge vessel to the outside. The enclosure may preferably be made out of quartz glass and may be of any geometry, e.g. cylindrical, generally elliptical or other. The enclosure is sealed to the outside and filled with a gas at reduced pressure (pressure below 1 bar). The outer enclosure serves as insulation to keep the discharge vessel at a relatively high operation temperature, despite the reduced electrical power.

In order to reduce the heat flow from the discharge vessel, the outer enclosure is provided at a certain distance therefrom. For the purposes of measurement, the distance discussed here is measured in cross-section of the lamp taken at a central position between the electrodes. The gas filling of the outer enclosure is chosen, together with the distance and the pressure, such that a desired heat transition coefficient $$\frac{\lambda}{d_2}$$

is achieved. Preferred values for $$\frac{\lambda}{d_2}$$

are 23.3-75 W/(m$^2$K). Preferably, the outer enclosure is arranged at a distance of 0.2-0.9 mm to the discharge vessel.

According to a preferred embodiment, the gas filling of the outer enclosure is at a pressure of 10-700 mbar, further preferred 10-300 mbar. The gas filling is preferably a rare gas, most preferably chosen out of Xenon and Argon. Due to the lower thermal conductivity of Xenon, it is preferred to have at least 20%, further preferred at least 50% Xenon in the filling.

The invention further relates to a lighting system including a discharge lamp as described above connected to an electrical power supply. Preferably, the power supply is disposed to operate the discharge lamp—preferably after ignition and an initial run-up phase—at a steady-state operating power of 25 W. Further preferred, the lighting system includes a reflector in which the lamp may be mounted, such that light emitted from the lamp is reflected at the reflector to form a resulting beam. The lighting system is particularly preferred as an automotive front lighting system.

BRIEF DESCRIPTION OF THE DRAWINGS

The above and other objects, features and advantages of the present invention will become apparent from the following description of preferred embodiments, in which.

DETAILED DESCRIPTION OF EMBODIMENTS

The preferred embodiments of the invention are intended to be used as automotive lamps for vehicle head lights. Since such automotive high pressure gas discharge lamps are known per se, the following description of the preferred embodiments will primarily focus on the special features of the invention.

Figure 1:
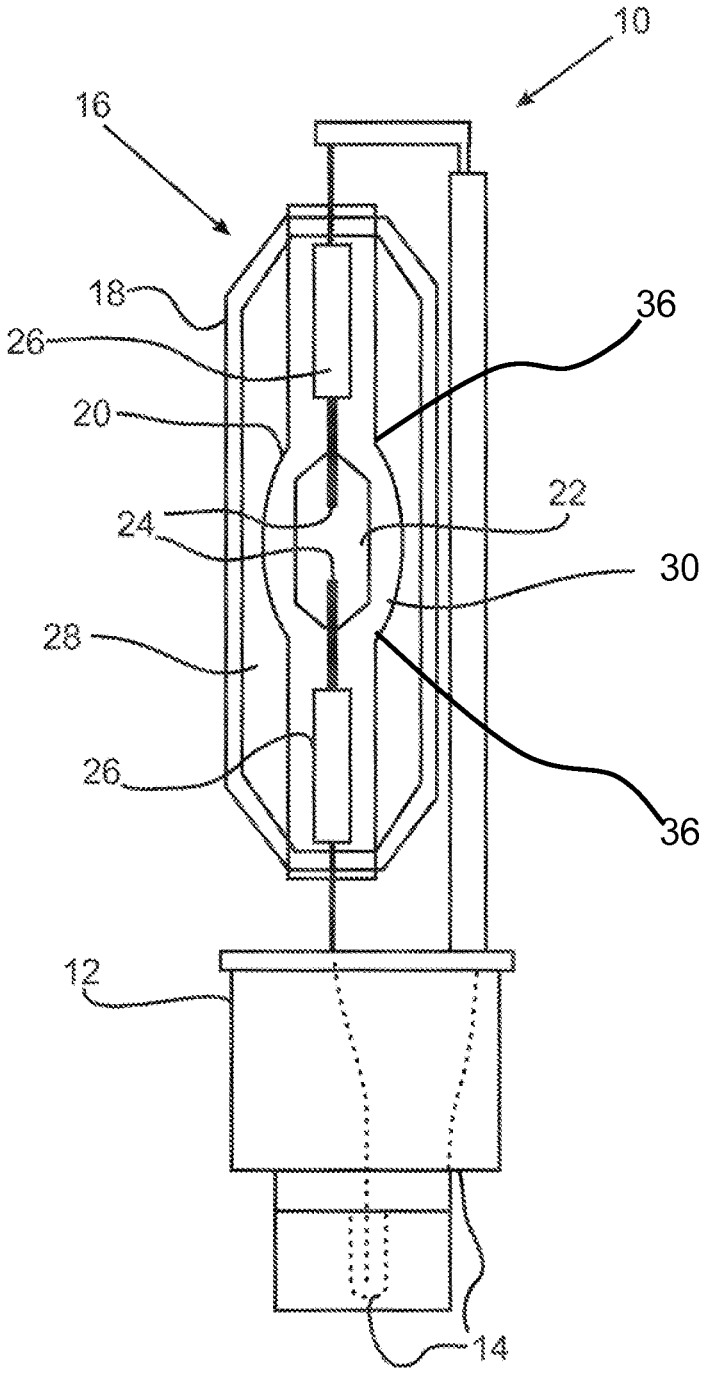
FIG. 1 shows a side view of a lamp according to an embodiment of the invention.

FIG. 1 shows a side view of a first embodiment 10 of a discharge lamp. The lamp comprises a base 12 with two electrical contacts 14 which are internally connected to a burner 16.

The burner 16 is comprised of an outer enclosure (in the following referred to as outer bulb) 18 of quartz glass surrounding a discharge vessel 20. The discharge vessel 20 is also made of quartz glass and defines an inner discharge space 22 with projecting, rod-shaped electrodes 24. The glass material from the discharge vessel further extends in longitudinal direction of the lamp 10 to seal the electrical connections to the electrodes 24 which comprise a flat molybdenum foil 26.

The outer bulb 18 is, in its central portion, of cylindrical shape and arranged around the discharge vessel 20 at a distance, thus defining an outer bulb space 28. The outer bulb space 28 is sealed.

Figure 2:
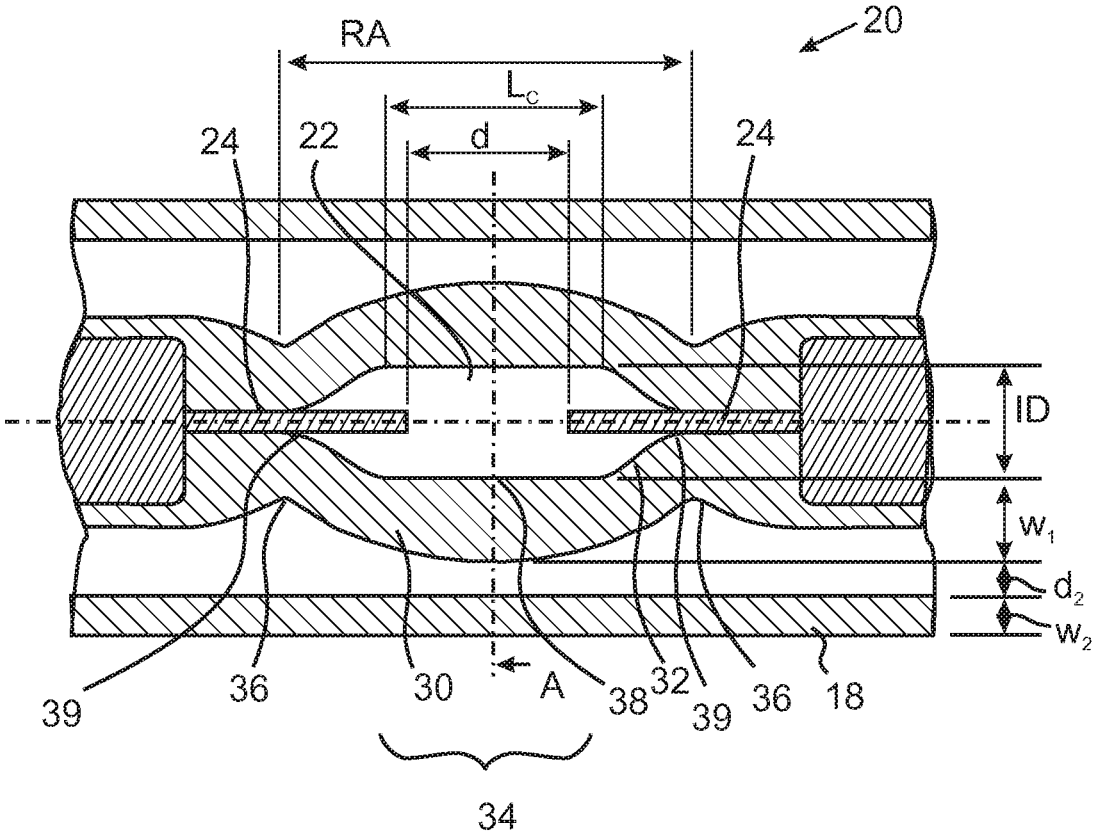
FIG. 2 shows an enlarged view of the central portion of the lamp shown in FIG. 1.

As shown in greater detail in FIG. 2, the discharge vessel 20 has an outer wall 30 arranged around the discharge space 22. The outer shape of the wall 30 is ellipsoid. The discharge space 22 comprises a central cylindrical portion 34 of a length $L_C$. In production, the discharge vessel is formed from a cylindrical quartz glass tube. Conical end portions 32 are obtained in a groove forming process, where grooves 36 are formed at a groove distance RA. The electrodes 24 are inserted into the end portions 32.

Thus, in the finally obtained discharge vessel 20 the electrodes 24 are embedded into the discharge vessel wall 30 at the end portions 32.

The wall 30 surrounding the discharge space 22 is of varying thickness, with the thickness being greatest at a position corresponding to the center between the electrodes 24, and decreasing towards both sides.

Figure 2A:
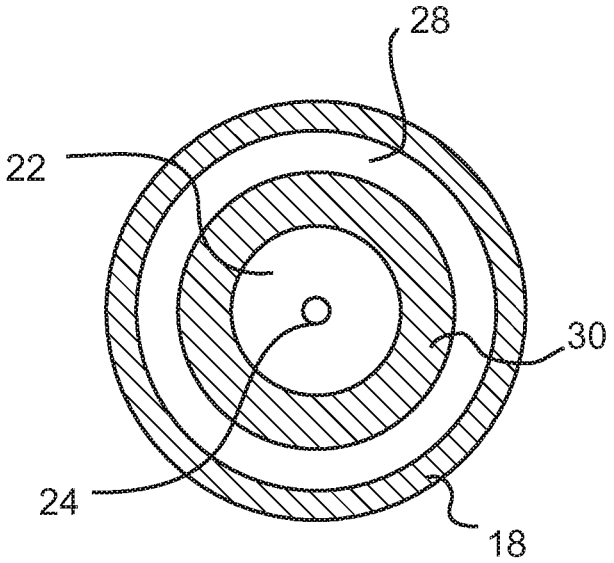
FIG. 2*a* shows a cross-sectional view along the line A in FIG. 2.

The discharge vessel 20 is characterized by the groove distance RA, electrode distance d, the cylindrical length $L_C$, the inner diameter ID of the discharge vessel 20, the wall thickness $w_1$ of the discharge vessel, the distance $d_2$ between the discharge vessel 20 and the outer bulb 18, and the wall thickness $w_2$ of the outer bulb 18. Here, the values ID, $w_1$, $d_2$, $w_2$ are measured in a central perpendicular plane of the discharge vessel 20, as shown in FIG. 2*a*.

The lamp 10 is operated, as conventional for an automotive discharge lamp, in horizontal orientation by igniting an arc discharge between the electrodes 24. Light generation is influenced by the filling comprised within the discharge space 22, which is free of mercury and includes metal halides as well as a rare gas.

Regarding the thermal behavior of a discharge lamp 10 as shown, due to the horizontal orientation during operation the arc discharge between the electrodes 24 will lead to a hot spot at the wall 30 of the discharge vessel 20 above the arc. Likewise, opposed portions of the wall 30 surrounding the discharge space 22 will remain at comparatively low temperatures (coldest spot).

In order to reduce heat transport from the discharge vessel 20 to the outside, and to maintain high temperatures necessary for good efficacy, it is preferable to provide the outer bulb 18 with reduced heat conduction. In order to limit cooling from the outside, the outer bulb 18 is sealed and filled with a filling gas of reduced heat conductivity. The outer bulb filling is provided at reduced pressure (measured in the cold state of the lamp at 20° C.) of less than 1 bar. As will be further explained below, the choice of a suitable filling gas should be made in connection with the geometric arrangement in order to achieve the desired heat conduction from discharge vessel 20 to outer bulb 18 via a suitable heat transition coefficient $\lambda/d_2$.

The heat conduction to the outside may be roughly characterized by a heat transition coefficient $\lambda/d_2$, which is calculated as the thermal conductivity $\lambda$ of the outer bulb (which in the present context is always measured at a temperature of 800° C.) filling divided by the distance $d_2$ between the discharge vessel 20 and the outer bulb 18.

Different types of filling gas, different values of filling pressure and different distance values $d_2$ may be chosen to obtain a desired heat transition coefficient $$\frac{\lambda}{d_2}.$$

The filling pressure is reduced (below 1 bar, preferably below 700 mbar, further preferred below 300 mbar). An especially preferred value is a filling pressure of 100 mbar. However, it has been found that in the preferred region the heat transition coefficient changes very little with the pressure.

Preferred distances $d_2$ range from 0.2-0.9 mm. The filling may be any suitable gas, chosen by its thermal conductivity value $\lambda$ (measured at 800° C.). For example, the thermal conductivity $\lambda$ of Neon is 0.120 W/(mK), of Oxygen 0.076 W/(mK), of Air 0.068 W/(mK), and of Nitrogen is 0.066 W/(mK).

To obtain good insulation, especially Argon (0.045 W/(mK)), Xenon (0.014 W/(mK)), or a mixture thereof is preferred as filling gas. However, since the heat transition coefficient is of course dependent on distance $d_2$, different gas fillings may also be chosen with a high enough $d_2$.

Preferred values for $$\frac{\lambda}{d_2}$$

range from 7.0 W/(m$^2$K) (achieved e.g. by a Xenon filling at a large distance of $d_2$=1.95 mm) to 225 W/(m$^2$K) (achieved e.g. by an Argon filling at a small distance of $d_2$=0.2 mm). Preferred is a range of 23.3 W/(m$^2$K) (achieved e.g. by a Xenon filling at $d_2$=0.6 mm) to 75 W/(m$^2$K) (achieved e.g. by an Argon filling at $d_2$=0.6 mm).

To be able to propose lamp designs with overall high lumen efficiency, several factors contributing to high efficiency may be adjusted as follows.

For the geometrical lamp design, thermal measures should be employed to raise the "coldest spot" temperature. If the discharge vessel is made smaller, the "coldest spot" temperature is raised, contributing to a high efficiency. Consequently, a smaller inner diameter of the discharge vessel leads to a higher efficiency. Thus, an inner diamter ID of preferably 2.1-2.3 mm is proposed.

A reduced outer diameter, which may be achieved by a reduced wall thickness, reduces heat radiation, thus raises the "coldest spot" temperature and the efficiency. As outer diameter, 4.5-6.5 mm are proposed.

Further, by choosing a high pressure of the enclosed rare gas, preferably Xenon, of preferably 12-16 bar, the efficiency is further improved.

Further measures relate to the metal halide composition. In particular, high arc efficiency may be obtained by choosing the mass ratio of sodium halides and scandium halides close to an about optimal value of 1.0-1.1.

For the metal halide composition, a high efficiency has been found for metal halide compositions with relatively high amounts of sodium iodide (NaI) and scandium iodide ($ScI_3$), which contain in addition Thulium iodide ($TmI_3$) and Indium iodide (InI).

In operation of a discharge lamp, the discharge vessel 20 is oriented horizontally as shown in FIG. 2. The temperature of the discharge vessel wall 30 will not be constant, but show a defined temperature profile. As far as the lower wall 30 in FIG. 2 is concerned, a coldest spot 38 will form centrally between the electrodes 24, whereas the discharge vessel wall 30 will have the highest temperature at embedding points 39, where the electrodes 24 are embedded within the quartz material of the discharge vessel 20.

The metal halides, which are solid in a cold lamp and are partly evaporated during operation of the lamp 10, are contained within the discharge space 22 in contact with the lower discharge vessel wall 30. Depending on the extension of the salt lake and on the temperature of the contacted portions of the lower discharge vessel wall 30, the metal halides will evaporate at different temperatures. If a large amount of metal halides is provided and the salt lake extends up to the inclined end portions 32, and thus nearer to the embedding points 39, a substantial amount of the metal halides will be evaporated at much higher temperatures than those present around the coldest spot 38.

As experiments, which will be explained in detail below, have shown, this has an influence on the color temperature obtained, because evaporation of metal halides at different temperatures will lead to different reactive species formed.

In the following, in accordance with the observations related above, an embodiment of a lamp will be discussed, which is intended to be used at a (steady-state) level of operating power (nominal operating power) of 25 W. The specific design is chosen with regard to thermal characteristics of the lamp in order to achieve high lamp efficacy.

In the preferred example, the discharge vessel and outer bulb are provided as follows:

Example HID lamp (25 W)

| | |
|---|---|
| Discharge vessel: | cylindrical inner shape<br>ellipsoid outer shape |
| Electrodes: | rod-shaped |
| Electrode diameter: | 250 μm |
| Electrode distance d: | 3.9 mm optical |
| Inner diameter ID: | 2.2 mm |
| Outer diameter $d_1 + 2 * w_1$: | 5.5 mm |
| Groove distance RA | 8.0 mm |
| Cylindrical length $L_C$ | 4 mm |
| Discharge vessel volume: | 19.5 μl |
| Wall thickness $w_1$: | 1.65 mm |
| Outer bulb inner diameter: | 6.7 mm |
| Outer bulb distance $d_2$: | 0.6 mm |

-continued

| | |
|---|---|
| Outer bulb filling: | 85% Xe, 10% $O_2$, 5% Ar, 100 mbar |
| Heat transition coeffient: | $\frac{\lambda}{d^2}$ 36.25 W/($m^2$K), measured at 800° C. |
| Outer bulb wall thickness $w_2$: | 1 mm |

The filling of the discharge space 22 consists of Xenon and a metal halide composition as follows:

| | |
|---|---|
| Xenon pressure (at 25° C.): | 14 bar |
| Metal halide composition: | 41 wt-% NaI, 36.5 wt-% $ScI_3$, 20 wt-% $TmI_3$, 2 wt-% $ThI_4$, 0.5 wt-% InI |
| Alternative metal halide composition (Th-free): | 39.75 wt-% NaI, 39.75 wt-% $ScI_3$, 20 wt-% $TmI_3$, 0.5 wt-% InI |

The above mentioned metal halide compositions were provided within the discharge vessel of the lamp described above in batches of lamps, each batch with different quantities of 100 μg to 300 μg. In each case, the generated luminous flux and the obtained color coordinates and color temperature were observed. Both compositions showed the same behavior with very little deviation, so that they will be discussed together.

Figure 3A:
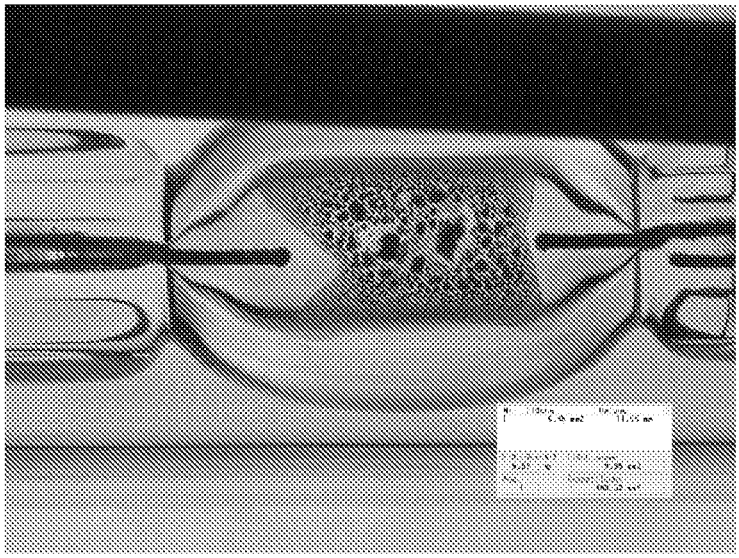
FIG. 3*a*, 3*b* show pictures of a salt lake formed in a discharge vessel after operation.
Figure 3B:
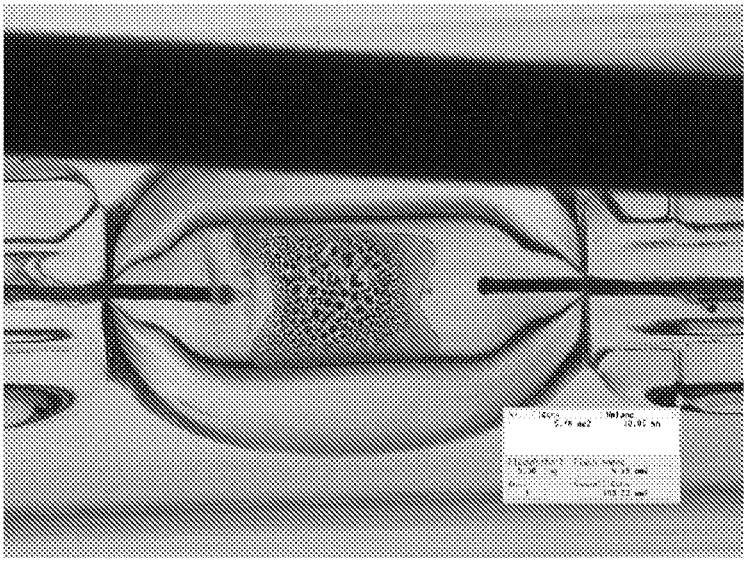
Figure 4:
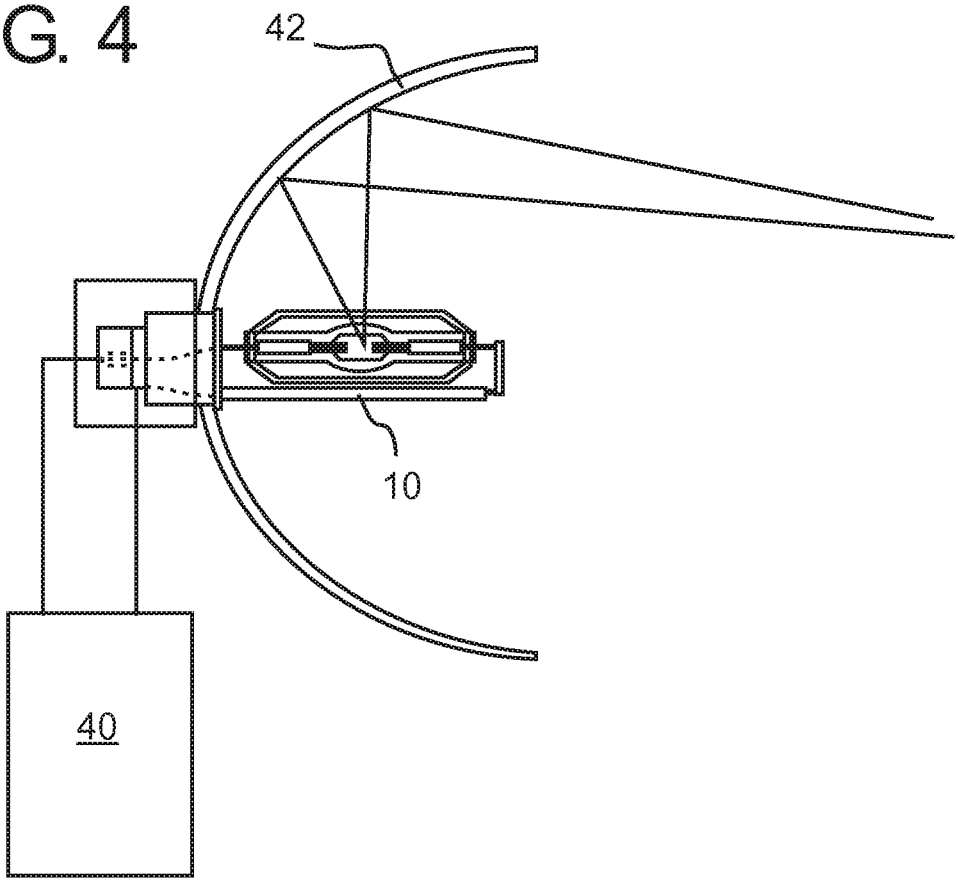
FIG. 4 shows a schematical representation of a lighting system.

The extension of the salt lake forming after operation of the discharge lamp was observed. In each case, the lamp was operated in steady-state operation for 30 minutes and then turned off. The metal halide composition, as expected, solidified in the discharge vessel, forming a salt lake generally positioned around the coldest spot. The lamps were observed from below (see FIG. 3*a*, 3*b*), and the extension of the salt lake was measured. In particular, the surface area $A_S$ of the salt lake was measured in $mm^2$. As will be appreciated by the skilled person, observation of the salt lake formed in a cylindrical vessel from only one side will introduce a certain systematical error, but it was found that the obtained values yielded sufficiently exact results nonetheless.

Figure 5:
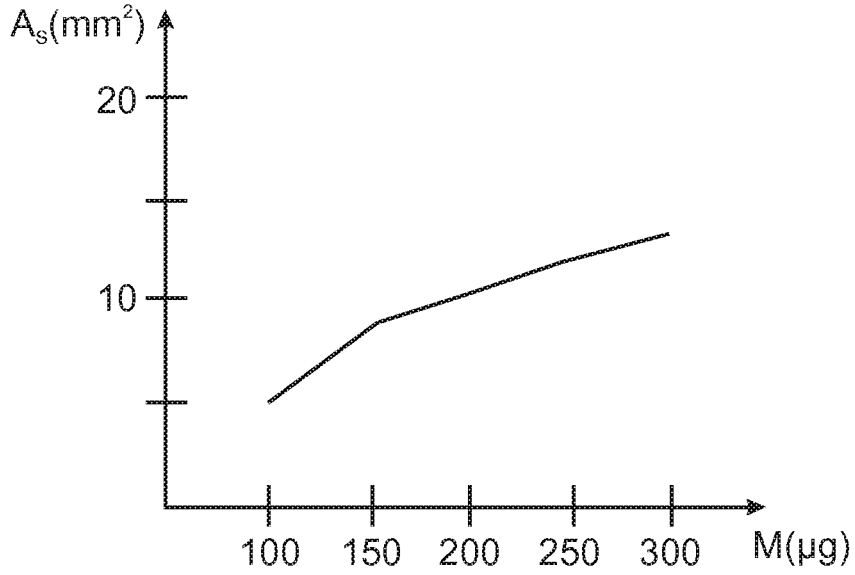
FIG. 5 shows a diagram of the surface area of a salt lake in dependence on the amount of metal halides.

As shown in FIG. 5, the area $A_S$ measured in $mm^2$ depends—for a given shape of a discharge vessel—on the amount of metal halides introduced into the discharge vessel.

As has surprisingly being found, a matching quotient Q may be obtained from the surface area of the salt lake $A_S$, the groove distance RA and the inner diameter ID of the discharge vessel. It have been found that the color temperature of the light emitted from the discharge lamp 10, with identical composition of the metal halides, showed a strong dependence on this matching quotient Q, calculated as Q=RA×ID/$A_S$.

Figure 6:
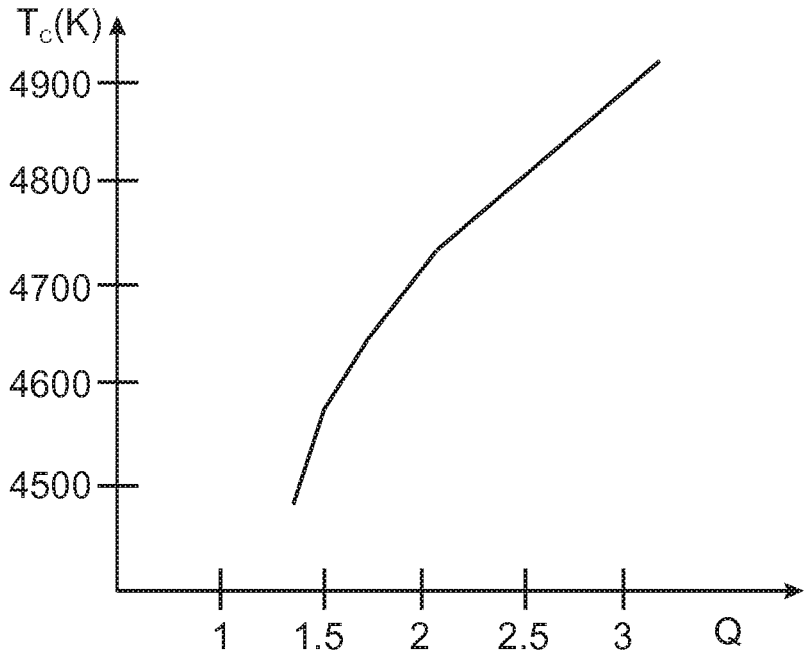
FIG. 6 shows a diagram showing the dependence of color temperature on a matching quotient Q.

FIG. 6 shows a graph of the dependency of color temperature on the matching quotient Q.

As visible from FIG. 6, the color temperature obtained increases nearly linearly with the matching quotient Q. For the given metal halide compositions, at a matching quotient Q=1.5, a color temperature of less than 4600 K is obtained, whereas matching quotient values of Q equal to or greater than 2, color temperatures of 4700 K and more are obtained, up to about 4900 K for Q=3.

Thus, as explained above, the extension of the salt lake determines which portions of the heated discharge vessel are contacted, and thus determines at which temperature the metal halides evaporate, leading to a strong influence on color temperature.

With both metal halide compositions, in operation at 25 W the luminous flux of the lamps (measures after 15 h burn-in) varied between 2188 lm for 100 μg metal halides and 2320 lm for 300 μg, corresponding to an efficiency of 87.5-92.8 lm/W. Thus, while there is a certain loss of efficiency associated with the reduced amount of halides, even the batch with highest quotient Q=3.2 (for 100 μg of halides) still showed high enough efficiency for automotive front lighting.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A discharge lamp, comprising:

a discharge vessel defining a sealed inner discharge space therein, the discharge space comprising an elongated central portion having an internal cross-sectional diameter (ID); and a first electrode and a second electrode, each projecting into said discharge space, an outerwall of the discharge vessel comprising a first groove where the first electrode is embedded, and a second groove where the second electrode is embedded, the first and second grooves configured to have a groove distance (RA) therebetween, wherein the said discharge space is charged with a rare gas and a metal halide composition, the metal halide composition being substantially free of mercury, such that when an arc discharge is formed between said first and second electrodes, the metal halide composition is at least partly evaporated, and after the arch discharge ceases, the metal halide composition forms a film on an inner wall of said discharge vessel, the film having a surface area ($A_S$), wherein the metal halide composition is charged into the discharge space in an amount such that a matching quotient (Q) having the formula:

$$Q = \frac{RA \cdot ID}{A_s}$$

is greater than or equal to 2.

2. The discharge lamp according to claim 1, wherein the lamp is configure to provide a luminous flux greater than of equal to 1800 lm when the lamp is operating at an electrical power of 25 W.

3. The discharge lamp according to claim 1, wherein the matching quotient (Q) is greater than or equal to 2.5.

4. The discharge lamp according to claim 3, wherein the matching quotient (Q) is greater than or equal to 3.

5. The discharge lamp according to claim 1, wherein the center portion of the discharge space has a cylindrical shape and is between the first and second electrodes.

6. The discharge lamp according to claim 5, wherein the center portion has a length ($L_C$) from 3 mm to 5 mm.

7. The discharge lamp according to claim 1, wherein the discharge space has a volume from 15 $mm^3$ to 21 $mm^3$.

8. The discharge lamp according to claim 7, wherein the volume of the discharge space is from 17 $mm^3$ to 20 $mm^3$.

9. The discharge lamp according to claim 1, wherein the internal cross-sectional diameter (ID) of the center portion of the discharge space is from 2.0 mm to 2.4 mm.

10. The discharge lamp according to claim 9, wherein the internal cross-sectional diameter (ID) of the center portion of the discharge space is from 2.1 mm to 2.3 mm.

11. The discharge lamp according to claim 1, wherein the metal halide composition comprises at least halides of Sodium and Scandium, wherein a mass ratio of the halides of Sodium and Scandium is in the range of 0.8-1.3.

12. The discharge lamp according to claim 11, wherein the mass ratio of the halides of Sodium and Scandium is in the range of 0.9-1.2.

13. The discharge lamp according to claim 1, wherein the metal halide composition comprises at least 10 wt-% of Thulium halide.

14. The discharge lamp according to claim 1, wherein the metal halide composition comprises from 0.05 wt-% to 0.7 wt-% of Indium halide.

15. The discharge lamp according to claim 1, wherein the metal halide composition comprises at least halides of Sodium, Scandium, Thulium and Indium.

16. The discharge lamp according to claim 1, wherein the rare gas in said discharge space is Xenon, the rare gas within the discharge space has a pressure from 10 bar to 18 bar at 20° C.

17. The discharge lamp according to claim 16, wherein the rare gas within the discharge space has a pressure from 12 bar to 16 bar at 20° C.

18. The discharge lamp according to claim 1, further comprising an outer enclosure surrounding the discharge vessel, said outer enclosure being sealed and filled with a gas at a pressure below 1 bar.

19. The discharge lamp according to claim 18, wherein the outer enclosure is configured such that a heat conduction coefficient having the formula:

$$\frac{\lambda}{d_2},$$

is in the range of 23.3-75 $W/(m^2K)$, where $\lambda$ is a thermal conductivity of the gas in the outer enclosure measured at 800° C., and $d_2$ is a distance between said outer enclosure and said discharge vessel.

20. A lighting system comprising the discharge lamp according to claim 1, wherein said discharge lamp is connected to an electrical power supply.

* * * * *